US006750402B2

(12) United States Patent
Geske

(10) Patent No.: US 6,750,402 B2
(45) Date of Patent: Jun. 15, 2004

(54) TENSION SPRING CLAMP WITH TEST TAP

(75) Inventor: Ralf Geske, Schieder-Schwalenberg (DE)

(73) Assignee: Phoenix Contact GmbH & Co. KG (DE)

( * ) Notice: Subject to any disclaimer, the term of this patent is extended or adjusted under 35 U.S.C. 154(b) by 107 days.

(21) Appl. No.: 10/223,738

(22) Filed: Oct. 29, 2002

(65) Prior Publication Data

US 2003/0047346 A1 Mar. 13, 2003

(30) Foreign Application Priority Data

Sep. 13, 2001 (DE) ..... 201 15 100 U

(51) Int. Cl.[7] ..... H01B 7/00

(52) U.S. Cl. ..... 174/135; 174/79; 174/84 C; 174/93; 439/882; 439/398; 439/402

(58) Field of Search ..... 174/135, 79, 84 C, 174/70, 93, 70 R; 439/882, 877, 398, 402

(56) References Cited

U.S. PATENT DOCUMENTS 3,622,955 A * 11/1971 Fernex ..... 439/828
4,351,583 A * 9/1982 Belttary ..... 439/839
4,964,811 A * 10/1990 Hayes et al. ..... 439/398
5,777,269 A * 7/1998 Handley ..... 174/78
6,015,953 A * 1/2000 Tosaka et al. ..... 174/79
6,323,430 B1 * 11/2001 Finona ..... 174/135
6,489,566 B1 * 12/2002 Durin ..... 174/135
6,512,179 B1 * 1/2003 DeCusatis ..... 174/135

* cited by examiner

*Primary Examiner*—Dhiru R Patel
(74) *Attorney, Agent, or Firm*—Charles E. Baxley

(57) ABSTRACT

A tension spring clamp assembly comprising: a housing (1) in which a tension spring (2) is attached by its bearing arm (3) to a power terminal (4) that protrudes through a clamping window (7) in a frontal section (6) of a spring arm (5) of the tension spring (2), and which is furnished with a conductor insertion aperture (8) below the power terminal (4) that in a clamped position faces an open area of the clamping window (7), and a test tap aperture (10) opposite an actuating aperture (9) allowing insertion of a contact pin (11 ) of a test plug (12) that contacts the power terminal (4). The test tap aperture (10) for insertion of the contact pin (11) is conformed as a hollow cylinder, wherein an extension of a cylinder axis (A) thereof extends along an inner side (13) of the bearing arm (3) that is facing away from the power terminal (4). An insertion aperture (14) for the contact pin (11) is also present in the frontal section (6) of the spring arm (5).

7 Claims, 4 Drawing Sheets

TENSION SPRING CLAMP WITH TEST TAP

BACKGROUND OF THE INVENTION

1. Field of the Invention

The present invention relates to a tension spring clamp having a housing in which a tension spring is attached by its bearing arm to a power terminal that protrudes through a clamping window in a frontal section of a spring arm of the tension spring. More particularly, the present invention relates to the housing being furnished with a conductor insertion aperture below the power terminal that in a clamped position faces an open area of the clamping window in the spring arm, above the power terminal, and level with a top centered range of the spring arm that is biased towards the bearing arm, an actuating aperture for inserting a tool for biasing the spring arm down onto the bearing arm, and a test tap aperture between the conductor insertion aperture and the actuating aperture through which a contact pin of a test plug may be inserted to contact the power terminal.

2. Description of the Prior Art

In known tension spring clamps the test tap aperture of the housing is located level with a frontal extremity of the power terminal that protrudes through the clamping window in the spring arm, wherein an extremity of the contact pin of the test plug is placed on only one point of the power terminal. Such an arrangement is known as a "touch control contact", which only ensures a reliable contact if the extremity of the contact pin of the test plug is forced by pressure against the frontal extremity of the power terminal. For this reason, the test plug must be held manually throughout a test tapping operation. If the test plug is released, transition resistances at the contact point may rise, which in turn lead to incorrect measurements.

SUMMARY OF THE INVENTION

The object of the present invention is therefore to provide a tension spring clamp with which a reliable contact of the test plug's contact pin with the power terminal is assured even if the test plug is released.

This object is solved in a tension spring clamp according to the present invention wherein the test tap aperture for insertion of the test plug's contact pin is conformed as a hollow cylinder, wherein an extension of a cylinder axis thereof runs along an inner side of the bearing arm of the tension spring that is facing away from the power terminal, and further in that besides the clamping window, an insertion window for the test plug's contact pin is provided in the frontal section of the spring arm of the tension spring, and still further in that the power terminal is provided with a deformation that protrudes into an insertion channel in such a manner that the contact pin that is inserted and retained in the test tap aperture is constrained adjacent thereto along its entire length.

It is important for the purposes of the present invention that when the contact pin of the test plug is inserted, and passes along the deformation of the power terminal, the contact pin is subjected to a small elastic radial excursion, so that the contact pin is brought into sprung contact with the deformation of the power terminal, which ensures reliable contact between the contact pin and the power terminal even if the test plug is released. In the contact position, the test plug's contact pin projects inside the tension spring of the tension spring clamp, and to accommodate such an additional insertion aperture must be provided in the frontal section of the spring arm of the tension spring. At the same time, however, the test tap is obstructed neither by the electrical conductor located in the conductor insertion area of the tension spring clamp nor by any tool that may be inserted into the actuating aperture of the clamp housing. Finally, the very fact that contact between the power terminal and the contact pin takes place inside the tension spring assures a particularly reliable test tap without a need to hold the test plug by hand throughout the operation.

In order to ensure that the contact tip of the test plug may be reliably inserted as far as the deformation of the power terminal regardless of a respective excursion of the spring arm, the insertion aperture in the frontal section of the spring arm of the tension spring must allow adequate play. To this end, therefore, the insertion aperture advantageously has a form of an elongated hole stretching in a direction of sprung displacement of the frontal section of the spring arm, and the elongated hole ultimately-opens into the clamping window of the spring arm.

It must further be assured that the tension spring clamp is seated securely on the power terminal. To this end, the bearing arm of the tension spring is advantageously furnished with a through-hole, through which the deformation of the power terminal protrudes, and which is form-fit to a shape of the through-hole. In this way, the deformation of the power terminal serves a dual purpose, not only assuring contact of the test plug's contact pin, but also acting as a mechanical restraint for the tension spring. In an advantageous configuration of the present invention, the deformation in the power terminal consists of a knuckle impressed therein, which is upset so that an area of its free extremity inside the bearing arm clasps an edge of the through-hole. Moreover, a process of upsetting the free frontal face of the knuckle-shaped deformation of the power terminal may be advantageously used to impress a groove-shaped profile therein, particularly a V-groove, in an area of which the test plug's contact pin makes contact as the length of the contact pin is adjacent to the sides of this profile.

In the following, the invention will be explained in greater detail with reference to the drawing and an exemplary embodiment thereof.

DETAILED DESCRIPTION OF THE PREFERRED EMBODIMENT

Figure 1:
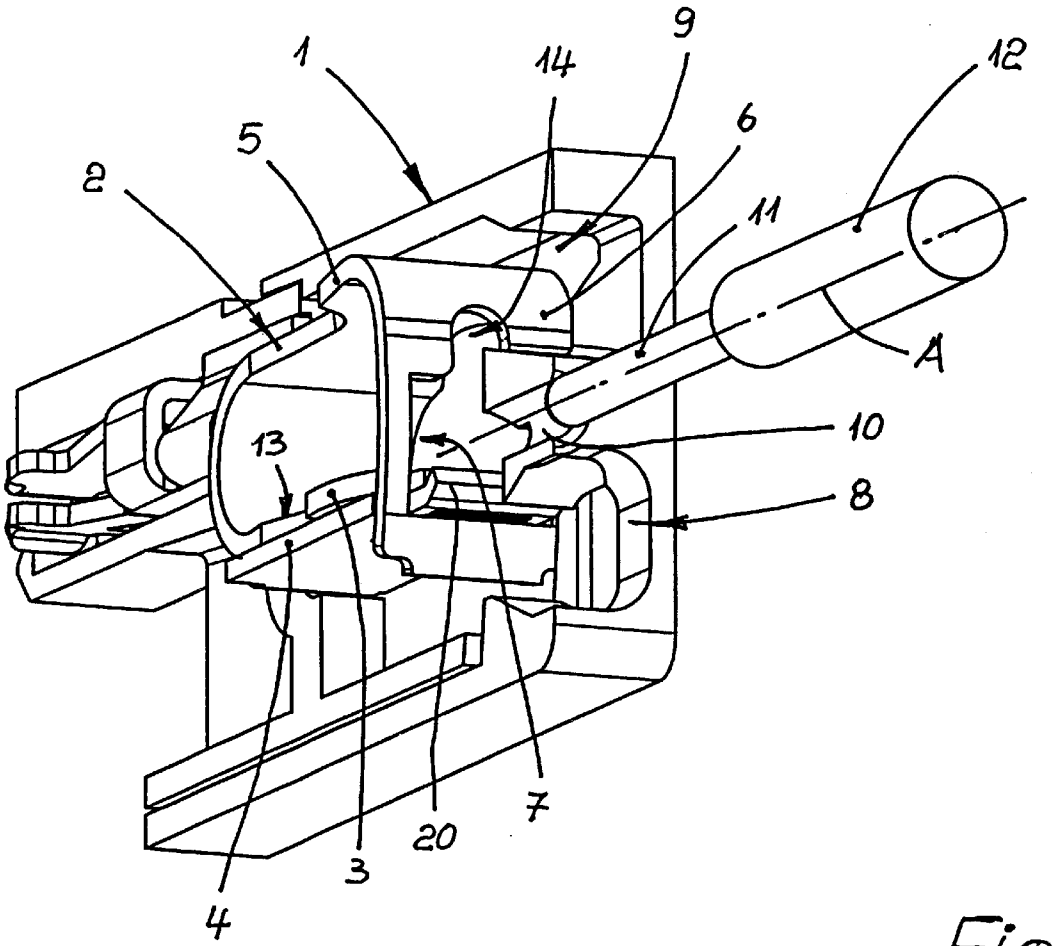
FIG. 1 is a diagrammatic perspective view of a tension spring clamp with a cutaway of a housing thereof.
Figure 2:
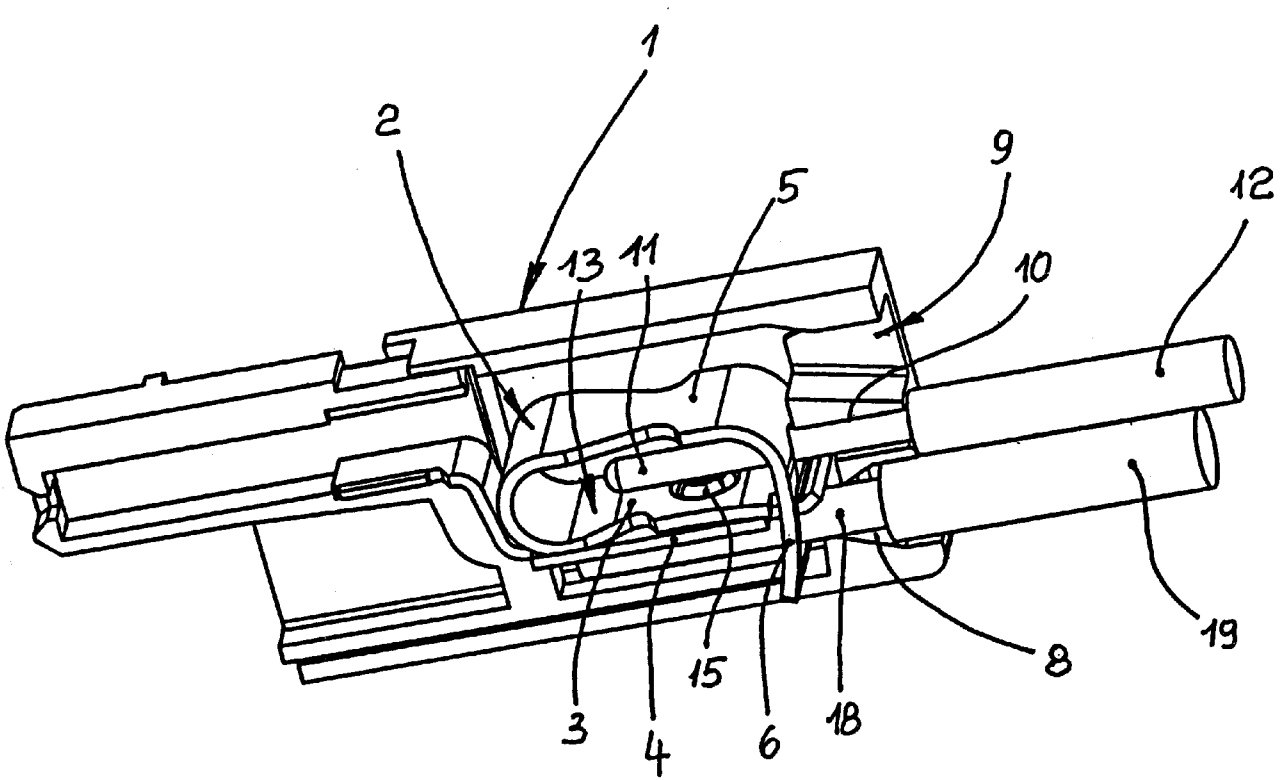
FIG. 2 is a diagrammatic perspective view of the tension spring clamp with a cutaway of the housing as in FIG. 1, but from a different angle.

Referring now to the figures, in which like numerals indicate like parts, FIGS. 1 and 2 show a clamp housing 1 made from plastic in a normal way, in which a tension spring 2 is arranged. The tension spring 2 has a bearing arm 3, with which it is attached to a power terminal 4. The tension spring 2 is made from a single piece and bent to form a loop, and is further furnished with a spring arm 5, which has a frontal section 6 with a clamping window 7. In an area of the clamping window 7, the frontal section 6 of the spring arm 5 extends essentially vertically as far as the bearing arm 3. The power terminal 4 has a forward extremity 20, which protrudes through the clamping window 7 in the frontal section 6 of the spring arm 5. On a side distal to the frontal section 6 the spring arm 5, the clamping window 7 is expanded because an insertion aperture 14 adjoins the clamping window 7, which insertion aperture 14 has a form of an elongated hole that is open at one end. In order to minimize weakening of material constituting the spring arm 5, a dimension of the insertion aperture 14 when viewed from a transverse direction of the frontal section 6 of the spring arm 5 is smaller than a dimension of the clamping window 7.

The housing 1 is furnished with a conductor insertion aperture 8, which determines direction in which a conductor terminal 18 of an insulated conductor 19 is to be inserted, and which extends along a side of the power terminal 4 that is facing away from the attached bearing arm 3 of the tension spring 2. In order to be able to insert the conductor terminal 18 without colliding with the tension spring 2, the spring arm 5 of the tension spring 2 may be depressed from its centered range towards the bearing arm 3, which causes the clamping window 7 in the frontal section 6 of the spring arm 5 to be displaced and to open below the forward extremity 20 of the power terminal 4. The spring arm 5 is depressed using a tool that may be inserted into the housing 1 through an actuating aperture 9. As shown in FIGS. 1 and 2, the actuating aperture 9 is located on a front face of the housing 1 and is upwardly aligned, whereas the conductor insertion aperture 8 on the front face of the housing 1 is downwardly aligned. After the tool is withdrawn, the conductor terminal 18 is biased to assure contact against an underside of the power terminal 4 by resilience of the spring arm 5.

A test tap aperture 10 is furnished between the conductor insertion aperture 8 and the actuation aperture 9 on the front face of the housing 1. The test tap aperture 10 has a form of a hollow cylinder in the housing 1 and serves to allow introduction of a contact pin 11 of a test plug 12, which when inserted protrudes inside the tension spring 2. A cylinder axis A of the test tap aperture 10, and accordingly that of the contact pin 11 inserted therein, extends above an inside 13 of the bearing arm 3 of the tension spring 2, and thus also on that side of the bearing arm 3 that faces away from the power terminal. In order to ensure that the contact pin 11 of the test plug 12 does not collide with the frontal section 6 of the spring arm 5 when the spring arm 5 is under spring loading, the insertion aperture 14 is provided as an expansion of the clamping window 7 in the frontal section 6 of the spring arm 5.

Figure 3:
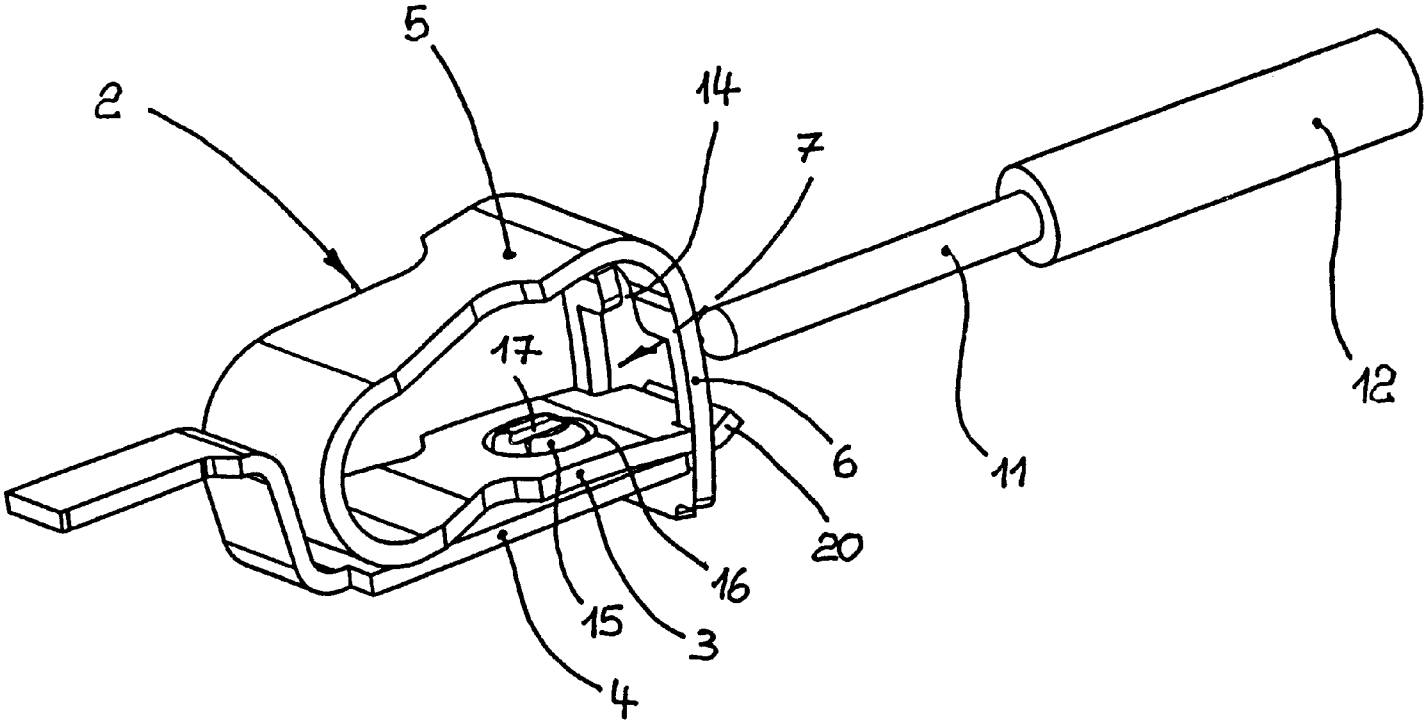
FIG. 3 is a diagrammatic perspective view of the tension spring of the tension spring clamp shown in FIGS. 1 and 2 attached to a power terminal.

As is shown in FIGS. 1 and 3, the contact pin 11 of the test plug 12 that is inserted through the test tap aperture 10 protrudes through the clamping window 7 of the spring arm 5 of the tension spring 2 when the conductor terminal 18 is not currently being clamped. When the conductor terminal 18 is clamped, as is shown in FIGS. 2 and 4, the insertion aperture 14 in the frontal face 6 of the spring arm 5 allows the contact pin 11 to penetrate inside the tension spring 2.

Figure 4:
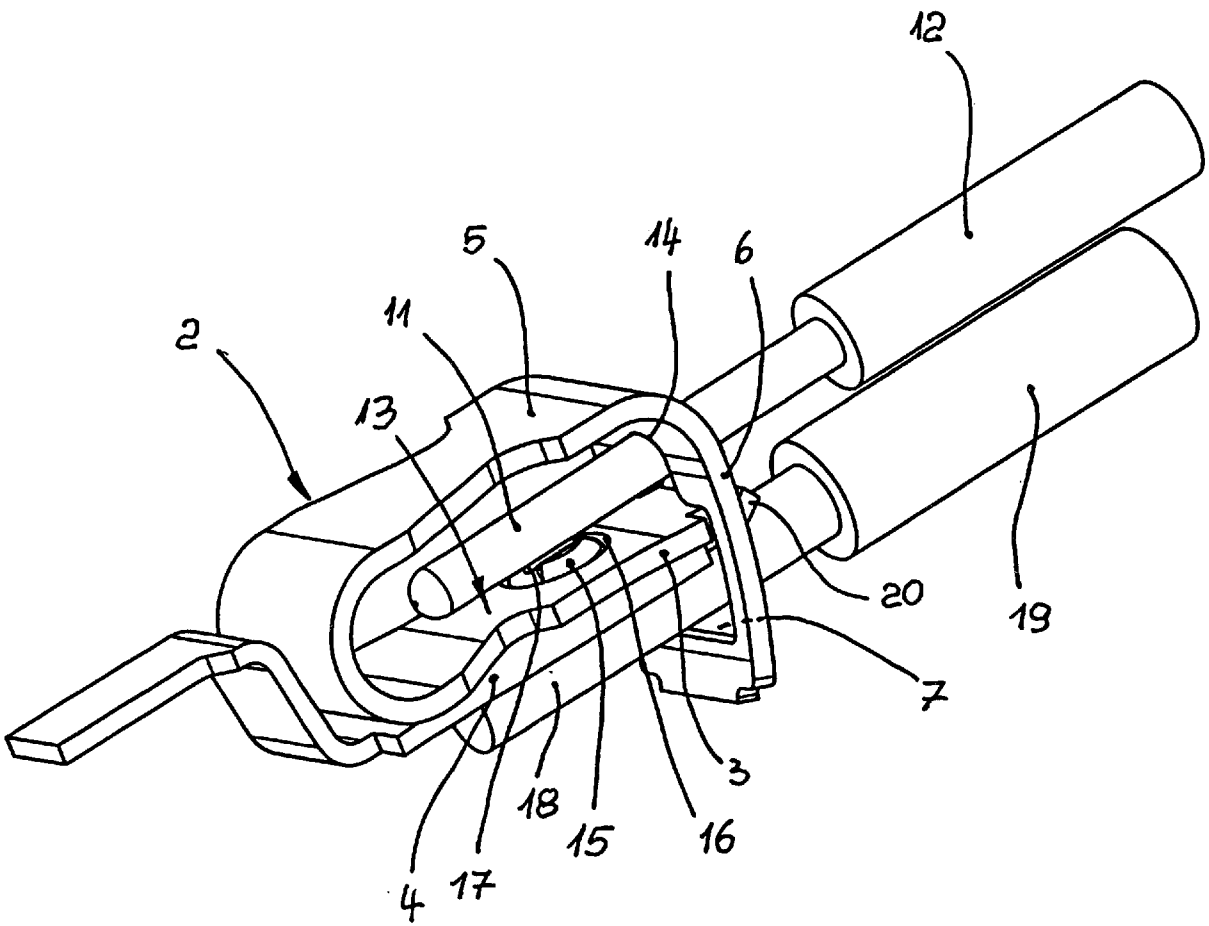
FIG. 4 is a diagrammatic perspective view of the tension spring shown in FIG. 3, but in a clamped position with a test plug inserted.

FIGS. 3 and 4 further show that the tension spring 2 is retained securely against the power terminal 4. To this end, a deformation 15 in a form of a knuckle is provided on the power terminal 4, to which the bearing arm 3 of the tension spring 2 is connected with a through-hole 16 having a correspondingly form-fit shape. An upsetting deformation or shoulder of the knuckle-shaped deformation 15 on the power terminal 4 overlaps an edge of the through-hole 16 on the inside 13 of the bearing arm 3, so that the tension spring 2 is secured against lifting away from the power terminal 4.

The special deformation 15 of the power terminal 4 has an advantage that the contact pin 11 of the test plug 12 that is inserted inside the tension spring 2, and which is automatically retained in the test tap aperture 10, is able to contact the power terminal 4. When the contact pin 11 runs up against the deformation 15 of the power terminal 4, the correspondingly elastically constituted contact pin 11 undergoes a minor radial excursion, which causes a constraint on the contact pin 11 in a direction of the cylinder axis A with respect to a precise course of the contact pin 11 in the test tap aperture 10. As a result, a contact pressure arises between the contact pin 11 and the deformation 15 of the power terminal 4 for a purpose of ensuring a good contact. This means that the test plug 12 may be released during testing, which provides manipulation advantages in clamping and testing operations. Moreover, the contact pin 11 of the test plug 12 is retained securely regardless of whether the conductor terminal 18 is clamped to the power terminal 4 by the tension spring 2. The power terminal 4 is provided with the deformation 15 that protrudes into an insertion channel 17 of the contact pin 11 in such a manner that the contact pin 11 of the test plug 12 that is inserted and retained in the test tap aperture 10 is constrained adjacent thereto along its entire length.

What is claimed is:

1. A tension spring clamp assembly comprises: a housing (1) in which a tension spring (2) is attached by its bearing arm (3) to a power terminal (4) that protrudes through a clamping window (7) in a frontal section (6) of a spring arm (5) of the tension spring (2), wherein the housing (1) is furnished with a conductor insertion aperture (8) below the power terminal (4) that in a clamped position faces an open area of the clamping window (7) in the spring arm (5), above the power terminal (4), and level with a top centered range of the spring arm (5) that is biased towards the bearing arm (3), wherein the housing (1) is further furnished with an actuating aperture (9) for inserting a tool for biasing the spring arm (5) down onto the bearing arm (3), and wherein the housing (1) is still further furnished with a test tap aperture (10) between the conductor insertion aperture (8) and the actuating aperture (9), through which a contact pin (11) of a test plug (12) may be inserted to contact the power terminal (4), wherein the improvement comprises:

the test tap aperture (10) for insertion of the contact pin (11) of the test plug (12) is conformed as a hollow cylinder having a cylindrical axis (A), wherein an extension of the cylinder axis (A) extends along an inner side (13) of the bearing arm (3) of the tension spring (2) that is facing away from the power terminal (4), wherein besides the clamping window (7) an insertion aperature (14) for the contact pin (11) of the test plug (12) is provided in the frontal section (6) of the spring arm (5) of the tension spring (2), and wherein the power terminal (4) is provided with a deformation (15) that protrudes into an insertion channel of the contact pin (11) in such a manner that the contact pin (11) of the test plug (12) that is inserted and retained in the test tap aperture (10) is constrained adjacent thereto along its entire length.

2. The tension spring clamp according to claim 1, wherein the insertion aperture (14) in the frontal section (6) of the spring arm (5) of the tension spring (2) is an elongated hole stretching in a direction of sprig displacement of the frontal section (6) of the spring arm (5) of the tension spring (2).

3. The tension spring clamp according to claim 2, wherein the insertion aperture (14) opens into the clamping window (7) of the spring arm (5) of the tension spring (2) at one end.

4. The tension spring clamp according to claim 1, 2, or 3, wherein the bearing arm (3) of the tension spring (2) is furnished with a through-hole (16), through which the deformation (15) on the power terminal (4) protrudes, and which is form-fit to a shape of the through-hole (16).

5. The tension spring clamp according to claim 4, wherein the deformation (15) consists of a knuckle impressed into the power terminal (4), which is upset on the inside (13) of the bearing arm (3) of the tension spring (2) so that it overlaps an edge of the through-hole (16) thereof.

6. The tension spring clamp according to claim 5, wherein the deformation (15) of the power terminal (4) has a free frontal side and a diametrical, groove-shaped profile (17) on the free frontal side thereof to assure contact with the contact pin (11) of the test plug (12).

7. The tension spring clamp according to claim 4, wherein the deformation (15) of the power terminal (4) has a free frontal side and a diametrical, groove-shaped profile (17) on the free frontal side thereof to assure contact with the contact pin (11) of the test plug (12).

* * * * *

UNITED STATES PATENT AND TRADEMARK OFFICE

CERTIFICATE OF CORRECTION

PATENT NO. : 6,750,402 B2
DATED : June 15, 2004
INVENTOR(S) : Ralf Geske

It is certified that error appears in the above-identified patent and that said Letters Patent is hereby corrected as shown below:

Title page,
Item [22], "Filed" should read -- Filed: Aug. 20, 2002 --

Signed and Sealed this

Tenth Day of August, 2004

JON W. DUDAS
*Acting Director of the United States Patent and Trademark Office*